United States Patent [19]

Klink

[11] Patent Number: 4,848,746

[45] Date of Patent: Jul. 18, 1989

[54] TENNIS RACKET GRIP

[76] Inventor: William Klink, 29 Railroad Ave., Middletown, N.Y. 10940

[21] Appl. No.: 152,010

[22] Filed: Feb. 3, 1988

[51] Int. Cl.[4] ..... A63B 49/00

[52] U.S. Cl. ..... 273/73 J; 273/75; 273/81.4

[58] Field of Search ..... 273/73 J, 75, 81.4

[56] References Cited

U.S. PATENT DOCUMENTS

| | | | |
|---|---|---|---|
| 4,213,609 | 7/1980 | Swanson | 273/75 |
| 4,399,993 | 8/1983 | Melin | 273/73 J |
| 4,402,508 | 9/1983 | Pflueger | 273/73 J |

FOREIGN PATENT DOCUMENTS

| | | | |
|---|---|---|---|
| 2302271 | 7/1973 | Fed. Rep. of Germany | 273/75 |
| 3341256 | 5/1985 | Fed. Rep. of Germany | 273/73 J |
| 2493710 | 5/1982 | France | 273/73 J |
| 2573988 | 6/1986 | France | 273/75 |
| 2576219 | 7/1986 | France | 273/75 |

*Primary Examiner*—Robert E. Garrett
*Assistant Examiner*—Thomas Denion
*Attorney, Agent, or Firm*—Philip Furgang

[57] ABSTRACT

A grip is formed for a tennis racket handle to facilitate proper gripping of the racket for two handed backhand strokes of the tennis racket by either a left-handed or a right-handed tennis player. The grip includes a body portion having longitudinally aligned first and second protuberance extending therefrom and spaced one from the other by a predetermined distance. A third protuberance also extends from the body portion in radial alignment with the second protuberance and in a direction opposite thereto. An enlarged end section also extends from the body portion. The protuberances and enlarged section are disposed to facilitate either one handed gripping of the racket by either a left-hand or a right-hand player as well as two handed backhand gripping by either a left-hand or a right-hand player. The grip may be molded as a unitary piece substantially in the form of a hollow tube closed at one end and with an opening sized to receive the handle of a tennis racket. The grip may otherwise be formed on or with the tennis racket handle.

11 Claims, 1 Drawing Sheet

TENNIS RACKET GRIP

BACKGROUND OF THE INVENTION—FIELD OF APPLICATION

This invention relates to handgrips for athletic equipment; and, more particularly, to a form fitted grip with protuberances or bosses for facilitating a two handed backhand grip of a tennis racket.

BACKGROUND OF THE INVENTION—DESCRIPTION OF THE PRIOR ART

Many sports employ rackets, bats and the like to strike a ball when playing the game. The application of force to the ball in a controlled manner is usually critical to the effective execution of such games. That application of such force is furthermore facilitated by various techniques utilized to hold the racket, bat or the like. The technique of holding, grasping or gripping the racket in the game of tennis, for example, is particularly critical for proper play of that game and, therefore, a variety of such techniques, grasps and grips and specially designed tennis racket handles have been developed over the years.

Instruction in the game of tennis includes verbal and executional description of the various techniques, grasps and grips required for different strokes. Three basic techniques or grips are commonly known in the game of tennis; with variations on the basic three grips, eleven grips can be designated. A grip achieved by "shaking hands" with the tennis racket evolved in the Eastern United States clay courts. The Eastern forehand and backhand grips produce a ball at about waist high on a bounce. A powerful stroke can be achieved using the Eastern grip and it can also be used effectively for higher and lower balls. The soft clay and grass courts of Europe often resulted in the ball staying low. A more flexible grip, the Continental grip, places the palm of the hand more on the top of the racket handle to play the ball more effectively in these circumstances for both the forehand and backhand. Use of the Western forehand and backhand grips is less effective with low wide balls.

At times a player may need to use both hands on the tennis racket handle for added strength and stability in order to make a particular shot. When employing a double handed backhand grip the playing hand is usually placed at the butt end of the racket in a position essentially midway between the Eastern and the Continental grip. THe other hand is positioned above the playing hand essentially using an Eastern forehand grip. Double handed play of the forehand play is not generally used. In volleying, the double handed backhand will help a player provide improved strength and control to the backhand. This grip seems to limit the racket take-back and allows the player the ability to hit an aggressive backhand drive accurately. Such a backhand drive is an effective means of returning slow-moving, high balls around the mid-court area.

The various techniques, grasps and grips utilized in playing tennis are sometimes further enhanced by specially designed tennis racket handles and/or by the addition of a specially designed grip affixed to or otherwise carried by the tennis racket handle. For example, U.S. Pat. No. 259,448 granted on June 13, 1882 to E. E. Woodhouse for *Handle For Rackets Or Lawn Tennis Bats* shows a tennis handle grip construction; but one which does not facilitate rapid hand positioning, especially for two handed backhand play.

Other tennis grips which are alledged to assist in the gripping of the tennis racket with one hand are shown in U.S. Pat. No. 4,696,842 granted on Sept. 29, 1987 to Ruxton C. Doubt for *Custom Moldable Hand Grip* and in U. S. Pat. No. 3,905,598 granted on Sept. 16, 1975 to George M. Ballog for *Tennis Racket Hand Grip.* Both of the above show contoured finger positions in their respective grips but neither provides any quick means for positioning into the finger positions and there is no showing, teaching or suggestion in either for a two handed backhand grip.

U.S. Pat. No. 1,532,822 granted on Apr. 7, 1925 to I. S. Kemp for *Tool Handle* shows a handle with an essentially elastical shape in cross-section which seems to be designed to facilitate the effective use of tools such as hammers, axes and the like. This handle does not provide a teaching of a device which could be applied to the art of tennis racket handles to aid in the playing of the game of tennis.

Another handle design is shown in U.S. Pat. No. 3,084,938 granted on Apr. 9, 1963 to E. C. Kapanowski for *Safety Handgrip.* The grip seems to be applicable to baseball bats, tools and golf clubs particularly for preventing loss of ones grip, but is inapplicable for tennis racket handles. British Pat. No. 322,512 granted on Dec. 4, 1929 to Andrew George Wilson for *A New Or Improved Device For Facilitating The Correct Grip Of Golf Clubs* also seems to insure the correct holding of a golf club but is clearly not applicable to or usable with a tennis racket.

Another such grip is shown by Bill J. Jones who shows by a detachable grip with form fitting finger grooves in U.S. Pat. No. 3,838,110 granted on Feb. 25, 1975 for *Tennis Racket Grip.* However, that grip requires a nut and bolt to remain secure and no provisions are made for a two handed backhand grip. Still another tennis racket grip, alledged to help a player grip the racket properly using the various gripping techniques are shown in U.S. Pat. No. 4,664,381 granted on May 12, 1987 to Alford Aaron for *Grip For Tennis Racket.* Although the grip may facilitate a single handed grip there is no teaching, showing or suggestion of application to backhand play especially by both left or right handed players.

A two handed grip for a tennis racket is shown in: U.S. Pat. No. 4,399,993 granted on Aug. 23, 1983 to Arthur K. Malin for *Two Handed Tennis Racket.* This type of grip provides only an extended length handle but makes no provision for easy hand placement at designated positions.

It would thus appear that extensive efforts and developments have been made to facilitate the student and player of tennis in making the proper grip and directing the positioning of the tennis racket thereby. It would further appear, however, that none of the existing tennis racket grip constructions facilitate a proper double handed backhand grip of the tennis racket.

SUMMARY OF THE INVENTION

It is therefore an object of this invention to provide a new and improved handle grip.

It is another object of this invention to provide a new and improved tennis handle grip.

It is yet another object of this invention to provide a new and improved replacement tennis handle grip.

It is still another object of this invention to provide a new and improved tennis handle grip with a tacky feel and which prevents slipping.

It is yet still another object of this invention to provide a new and improved tennis handle grip with protuberances which facilitates fast hand positioning.

A further object of this invention is to provide a new and improved tennis handle grip for a two handed backhand stroke.

Yet a further object of this invention is to provide a new and improved tennis handle grip adaptable for right and left-handed players.

Still a further object of this invention is to provide a new and improved tennis handle grip with a tacky feel having protuberances which facilitate hand positioning of the player whether left or right-handed for the playing of a two handed backhand stroke.

Other objects, features and advantages of the invention in its details of construction and arrangement of parts will be seen from the above, from the following description of the preferred embodiment when considered with the drawing and from the appended claims.

BRIEF DESCRIPTION OF THE PREFERRED EMBODIMENT

Figure 1:
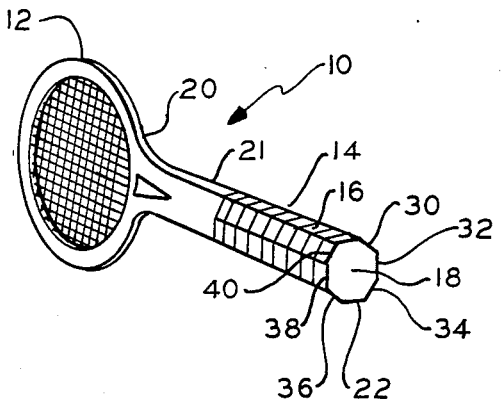
FIG. 1 PRIOR ART
FIG. 1 is a perspective view of a conventional tennis racket showing a conventional handle for reference purposes.

In FIG. 1, there is generally shown a tennis racket 10 conventional in design. A head 12 of racket 10 is shown facing away from the viewer with a handle 14 extending from head 12 toward the viewer. When viewed in this orientation a top plane 10 is defined to be the flat surface which extends longitudinally from a butt end 18 of racket 10 the length of handle 14 to a throat 20 which is a transition section of racket 16 between handle 14 and head 12. A shaft 21 extends longitudinally from handle 12 to throat 20. Opposite to top plane 16 is a bottom plane 22 similarly disposed. Four additional surfaces, designated as slants, are shown. These include an upper right slant 30 disposed between top plane 16 and a rear plane 32 where rear plane 32 is disposed essentially perpendicular to top plane 16 and bottom plane 22 and is otherwise similarly deployed between butt end 18 and throat 20. A lower right slant 34 is disposed between rear plane 32 and bottom plane 22 longitudinally extending between butt 18 and throat 20. A lower left slant 36, a front plane 38, and an upper left slant 40 also extend between butt 18 and throat 20. Front plane 38 is essentially parallel to rear plane 32 and perpendicular to top plane 16 and bottom plane 22. Upper left slant 40 is disposed between front plane 38 and top plane 16; while lower left slant 36 is disposed between front plane 38 and bottom plane 22.

The description which follows will use the orientation of racket 10 and racket handle 14 as described above. Although the exact shape of the surfaces may change they will be designated as described for convenience.

Figure 2:
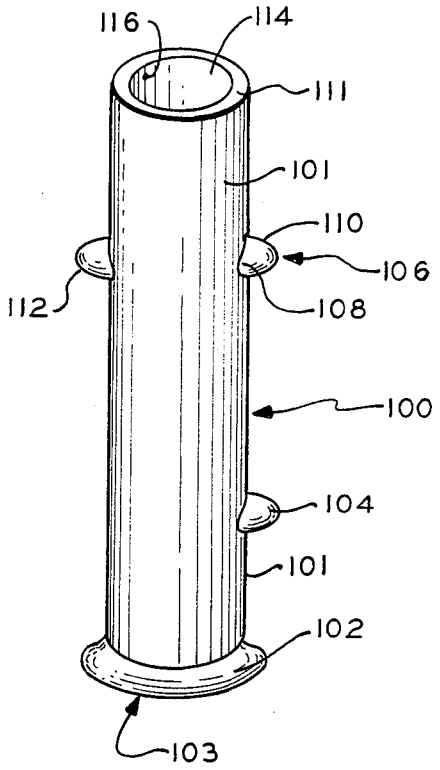
FIG. 2 is an enlarged elevation view of a tennis racket handle grip incorporating the instant invention.
Figure 3:
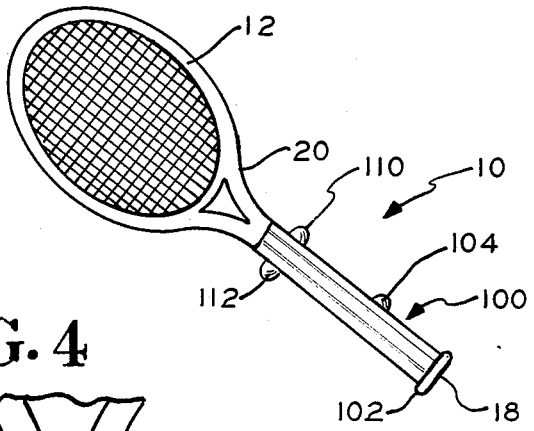
FIG. 3 is a frontal elevation view of a tennis racket with the handle grip of FIG. 2 applied thereto.
Figure 4:
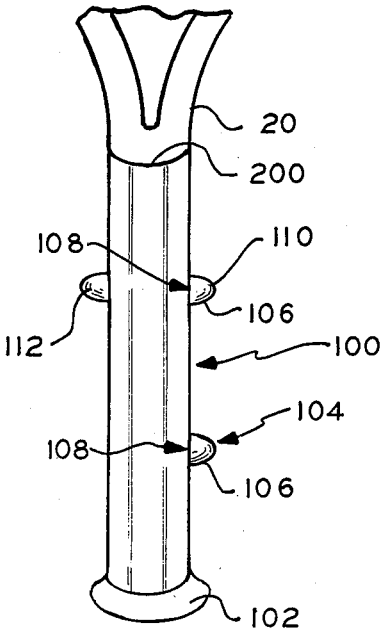
FIG. 4 is an enlarged elevation view of the tennis racket handle and grip of FIG. 3.

In FIG. 2 a grip 100 is shown, while in FIGS. 3–4 grip 100 is shown disposed on racket 10 extending longitudinally from butt 18 to throat 20. The material of grip 100 is Kraton® a specially formulated petrochemical material which imparts consistent feel which is tacky and has a cushion effect to absorb shock, vibrations and torque.

Grip 100 includes a body portion 101 (FIG. 2) and an enlarged section 102 which is greater in diameter than body portion 101 and is disposed at a first end 103 of grip 100. A first protuberance 104 extends essentially perpendicular from body portion 101 at a predetermined distance from enlarged section 102. Protuberance 104 has a height 106 and a diameter 108 each of predetermined size and a predetermined configuration all to coact effectively with the fingers of the player. A second protuberance 110, substantially identical to first protuberance 104, is disposed longitudinally forward of and aligned with protuberance 104 towards a second end 111 of grip 100. A third protuberance 112, disposed diametrically opposite and radially aligned with protuberance 110, is of a height, diameter and configuration that is substantially identical to protuberance 110 and 112.

Grip 100 is formed as a hollow sleeve and includes an internal opening 114 extending inwardly from end 111 up to an end wall (not shown) proximate enlarged section 102. Opening 114 may be of any convenient configuration such as cylindrical, octagonal or the like as long as opening 114 will receive racket handle 14 as described below.

Application of grip 100 onto tennis racket 10 in the area of handle 14 and shank 21 is achieved by first removing any other grip which may be attached to handle 14 and then proceeding as follows. Holding grip too in a vertical position fold back a predetermined amount of body portion 101 extending from end 111 approximately ½ inch to facilitate pouring of a solvent such as lighter fluid, charcoal lighter fluid or the like into opening 114 (FIG. 2) of grip 100. The action of the solvent will make the interior surface 116 of opening 114 slippery and expandable. After the solvent has been amply applied push grip 100 onto handle 14 and shank 21 until the inner surface (not shown) of section 102 hits butt 18. Rotate grip 100 to align protuberances 104 and 110 to be essentially central to top plane 16 of handle 14 and shank 21.

Figure 5:
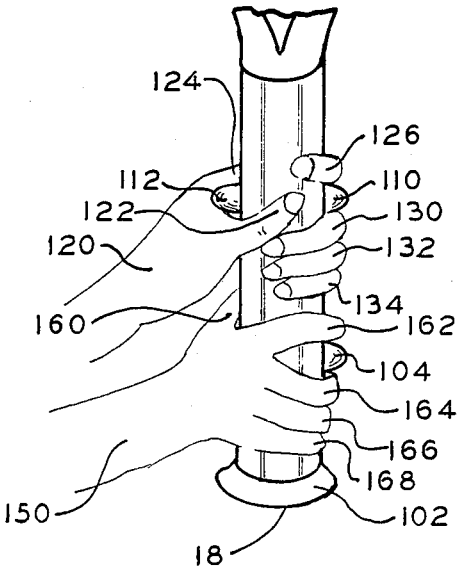
FIG. 5 is an enlarged elevation view of the tennis racket handle and grip of FIGS. 3 and 4 illustrating the two handed backhand grip for a right-handed player.

Use of racket 10 with grip 100 is best illustrated in FIG. 5 wherein use of the invention can be seen with hands in place. Reference in this description to planes, slants and other elements of handle 14 mean the respective element that is disposed within grip 100. To grasp racket 10 in the execution of a two handed backhand stroke using grip 100, for right-handed players, the players left hand 120 is positioned to form a V by placing the left thumb 122 and left index finger 124 under third protuberance 112. The end portion 126 of left index finger 124 extends around body portion 101 of grip 100 proximate shaft 21, bottom right slant 34, rear plane 32, upper right slant 30 and rests on upper plane 16 above second protuberance 110. Similarly, extended around shaft 21 are a left middle finger 130, a left ring finger 132 and a left pinky finger 134; with the left palm resting on body portion 101 of grip 100 proximate bottom plane 22. These three fingers (130–134) are, however, deployed below second protuberance 110 extending toward butt 18. The players right-hand 150 is deployed so as to form a V at the bottom plane longitudinally located essentially even with firt protuberance 104. The players right thumb 160 rests on a body protion 101 of grip 100 proximate bottom plane 22, lower right slant 34, and rear plane 32 and may extend onto upper right slant 30. The players right forefinger 162 extends above first protuberance 104 upon body portion 101 of grip 100 encompassing top plane 16, upper left slant 40, front plane 36, lower left slant 36 and bottom plane 22. Extended in a similar manner to right forefinger 162 are a right middle finger 164, a right ring finger 166, and a right pinky 168. Right pinky 168 is furthermore contained by enlarged section 102 with the right palm resting on bottom plane 22. For left-handed players the hands will be reversed from that described above.

While grip 100 has been shown as a device attachable to a tennis racket handle it may be just as well formed integral therewith.

It will thus be seen that there has been shown a new and improved tennis racket grip particularly usable for two handed backhand strokes by both left-handed and right-handed tennis players. This new and improved grip is of a size and configuration to facilitate not only two handed backhand tennis strokes as well as other tennis strokes but also: provides fast hand positioning for quick returns; prevents slipping; provides a positive feel and a better grip and grip feel; and butt end security. The grip is readily attachable to existing tennis racket handles.

It should be understood that although I have shown the preferred embodiment of my invention that various modifications may be made in the detials thereof without departing from the spirit as comprehended by the following claims.

What is claimed is:

1. A grip for encompassing a portion of the end of the handle of a tennis racket, comprising:

(a) body means for facilitating gripping of the tennis racket;

(b) said body means extending between a first end and a second end and having an outer surface of predetermined configuration for most of its length;

(c) an enlarged section disposed at said first end of said body means and extending out from said outer surface;

(d) a first protuberance of predetermined size and configuration extending out from said outer surface at a first predetermined location between said first end and said second end of said body means;

(e) a second protuberance of predetermined size and configuration extending out from said outer surface at a second predetermined location between said first protuberance and said second end of said body means;

(f) a third protuberance of predetermined size and configuration extending out from said outer surface at a third predetermined location between said first and said second end of said body means; wherein said first protuberance is spaced from said second protuberance and said third protuberance by a distance sufficient to facilitate the gripping of the tennis racket by both hands of a person.

2. The grip of claim 1, wherein said first protuberance is of a size, configuration and disposition to receive one hand of a person when holding the racket and wherein said second protuberance and said third protuberance are each of a size, configuration and disposition with respect to said first protuberance and each other to receive the other hand of a person, said first protuberance, said second protuberance and third protuberance acting together to guide the person holding the racket into a proper two handed backhand grip.

3. The grip of claim 2, wherein said first protuberance, said second protuberance and said third protuberance are of a size, configuration and disposition to receive the right hand of the person holding the racket proximate to and in cooperation with said first protuberance and the left hand of the person holding the racket proximate to and in cooperation with said second and said third protuberance.

4. The grip of claim 3, wherein said size, configuration and disposition of said first protuberance, said second protuberance and said third protuberance is such as to also receive the left hand of the person holding the racket proximate to and in cooperation with said first protuberance and the right hand of the person holding the racket proximate to and in cooperation with said second and said third protuberances.

5. The grip of claim 4, including an enlarged section disposed at said first end of said body means and extending therefrom for cooperation with the pinky of a hand.

6. The grip of claim 5, wherein said body means, said first, second and third protuberances, and said enlarged section are formed of plastic material.

7. The grip of claim 6, wherein the plastic material is Kraton®.

8. The grip of claim 7, wherein said body means, said first, second and third protuberances and said enlarged section are formed by molding.

9. The grip of claim 8, wherein said body means, said first, second and third protuberances and said enlarged section are formed as a unit.

10. The grip of claim 9, wherein said body means is formed as a hollow tube closed at said first end and having an opening extending inwardly from said second end to terminate at an inner wall proximate said first end; said opening being of a size and configuration to receive the handle of a tennis racket.

11. The grip of claim 10, wherein when said opening receives the handle of a tennis racket so that said first protuberance and said second protuberance are disposed to extend up from an imaginery plane corresponding to a top plane of the tennis racket handle; the top plane of the tennis racket handle being perpendicular to the face of the tennis racket.

* * * * *